US011060395B2

(12) United States Patent
Lolla et al.

(10) Patent No.: US 11,060,395 B2
(45) Date of Patent: Jul. 13, 2021

(54) METHOD FOR ZONAL INJECTION PROFILING AND EXTRACTION OF HYDROCARBONS IN RESERVOIRS

(71) Applicant: ExxonMobil Upstream Research Company, Spring, TX (US)

(72) Inventors: Sri Venkata Tapovan Lolla, Houston, TX (US); Badrinarayanan Velamur Asokan, Houston, TX (US); Jerome Lewandowski, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 22 days.

(21) Appl. No.: 16/679,958

(22) Filed: Nov. 11, 2019

(65) Prior Publication Data

US 2020/0190968 A1 Jun. 18, 2020

Related U.S. Application Data

(60) Provisional application No. 62/778,636, filed on Dec. 12, 2018.

(51) Int. Cl.
*E21B 47/07* (2012.01)
*E21B 41/00* (2006.01)
(Continued)

(52) U.S. Cl.
CPC ..... *E21B 47/07* (2020.05); *E21B 41/0092* (2013.01); *E21B 44/10* (2013.01); *E21B 47/047* (2020.05)

(58) Field of Classification Search
CPC .... E21B 47/07; E21B 47/047; E21B 41/0092; E21B 44/10; E21B 43/16; E21B 2200/20; E21B 43/14
See application file for complete search history.

(56) References Cited

U.S. PATENT DOCUMENTS

2014/0182841 A1* 7/2014 Lecerf ..... E21B 43/25 166/250.01
2016/0010443 A1* 1/2016 Xu ..... E21B 43/26 166/250.1

(Continued)

OTHER PUBLICATIONS

Nowak, T. J. (1953) "The Estimation of Water Injection Profiles from Temperature Surveys", *Soc. Petro. Eng.*, SPE-953203-G, v. 5(08), pp. 203-212.

(Continued)

*Primary Examiner* — Brad Harcourt
(74) *Attorney, Agent, or Firm* — Leandro Arechederra, III

(57) ABSTRACT

Herein disclosed are methods and systems related to processes for injection wells generally utilized in the oil and gas industry. More particularly, disclosed herein are methods and systems related to improving the accuracy of profiling and determining individual cumulative fluid injection profiles for an injection period for multiple zones of an injection well in reservoir systems utilizing conventional warmback models. The methods herein allow for proper modeling and allocation of all injection zones, including zones experiencing a cooldown phenomena during shut-in by transforming the cooldown zonal temperature profiles into temperature profiles which can be utilized in a conventional warmback analysis. These methods are particularly useful in mature reservoir systems where the background reference temperature profile is no longer governed by the geothermal reference temperature profile.

19 Claims, 3 Drawing Sheets

(51) Int. Cl.
*E21B 44/10* (2006.01)
*E21B 47/047* (2012.01)

(56) References Cited

U.S. PATENT DOCUMENTS

| | | | | |
|---|---|---|---|---|
| 2017/0009569 | A1* | 1/2017 | Manin | E21B 47/103 |
| 2019/0120043 | A1* | 4/2019 | Gupta | E21B 49/08 |
| 2019/0145250 | A1* | 5/2019 | Ruhle | G01N 29/2418 166/250.1 |

OTHER PUBLICATIONS

Smolen, J. J. et al. (2003) "Distributed Temperature Sensing. A DTS Primer for Oil & Gas Production," *Shell International Expl. and Prod.*, The Netherlands, https://www.yumpu.com/en/document/view/35102974/distributed-temperature-sensing-a-dts-primer-foroil-gas-producton , 24 pages.

Mehtiyev, N. et al. (2012) "Determination of Water Injection Zonal Allocation from Distributed Temperature Sensing Data," *Soc. Petro. Eng.*—Western Reg. Mtg., SPE-153809-MS, 20 pages.

Glasbergen, G. et al. (2009) "Real-Time Fluid Distribution Determination in Matrix Treatments using DTS," SPE Production & Operations, SPE-107775, 24(01), 135-146.

* cited by examiner

METHOD FOR ZONAL INJECTION PROFILING AND EXTRACTION OF HYDROCARBONS IN RESERVOIRS

CROSS REFERENCE TO RELATED APPLICATIONS

This application claims the priority benefit of U.S. Provisional Patent Application No. 62/778,636, filed Dec. 12, 2018, entitled METHOD FOR ZONAL INJECTION PROFILING AND EXTRACTION OF HYDROCARBONS IN RESERVOIRS.

FIELD

The present disclosure is related to processes for injection wells generally utilized in the oil and gas industry. Specifically, disclosed herein are methods and systems related to profiling and determining individual cumulative fluid injection profiles for an injection period for multiple zones of an injection well in multi-reservoir systems.

Definitions

For the ease of reference, certain terms used in this application and their meanings as used in this context are defined in this section. To the extent a term used herein is not defined below, it should be given the broadest definition persons in the pertinent art have given that term, as reflected in at least one printed publication or issued patent.

The term "greenfield" refers to an oil or gas field in which none or little (less than a month) prior development has taken place. In particular, greenfields are hydrocarbon fields which do not have any history of production or injection operations.

The term "brownfield" refers to an oil or gas field in which considerable prior development has occurred. The development herein may refer either to injection or production operations, depending on the type of the hydrocarbon field. The specific period of development after which a field may be considered a brownfield may vary from one field to another. Typically, hydrocarbon fields with more than a few months to a few years of production or injection may be considered brownfields.

The term "Geothermal Temperature Profile", abbreviated on some occasions as "GTP", refers to the initial static equilibrium temperature of the earth as a function of the vertical depth, as measured at a location where no artificial heat exchange has taken place. The Geothermal Temperature Profile is a function of the underground rock properties and is a result of various natural heat exchange processes that occur inside the Earth. The derivative of the Geothermal Temperature Profile with respect to depth is referred to as the "Geothermal Gradient".

The term "multi-layer reservoir" refers to an underground hydrocarbon reservoir in which the hydrocarbons are distributed across multiple distinct layers of rock. The individual rock layers or intervals containing the hydrocarbons are referred to as "pay zones".

The "Long-Term Shut-In Temperature Profile", abbreviated as "LSTP" or "LTSITP", is defined as the temperature profile in the wellbore of an injector or producer well, measured after a long-term shut-in. The shut-in duration describing "long-term" is case-specific and should be long enough so that any fluid cross-flow across pay zones has subsided.

In practice, long-term refers to, in absolute terms, as any shut-in that lasts longer than a threshold (typically 2-3 months). Alternately, it may be referred to in relative terms as the shut-in duration required to ensure that the temperatures measured at each depth along the wellbore, a specified time-interval apart (e.g. 1 week, 2 weeks, or 4 weeks), differ from each other less by than a relative threshold (e.g. 1%, 2%, 5%, 10% or 25% based on ° F.). The Long-Term Shut-In Temperature Profile may be derived from the compilation of multiple discrete "Long-Term Shut-In Temperatures", abbreviated as "LTSIT"s, determined at multiple elevations within the reservoir.

The term "mature reservoir" denotes a reservoir in which injection or production history has resulted in a Long-term Shut-In Temperature Profile that differs from the Geothermal Temperature Profile by more than a chosen threshold at any given depth. This threshold may be chosen to either be absolute (e.g., 2° F.) or relative (e.g., 2%) to the actual Geothermal Temperature Profile.

The term "sub-cooled reservoir" refers to a mature reservoir wherein at least portions of the Long-Term Shut-In Temperature Profile are lower in value than the Geothermal Temperature Profile at the corresponding depths.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Injection wells are used to pump fluids at high pressure into underground strata in order to displace hydrocarbons, improve hydrocarbon recovery and to provide reservoir pressure support for nearby producer wells. In producing fields with multiple reservoirs or multi-layered reservoirs, it is often economical to install a single injector well that can pump fluids into multiple pay zones at the same time.

"Injection Profiling", or "Injection Allocation" refers to the task of quantifying the volumes of fluid injected through the injection well into each of the underground reservoir pay zones. Accurate injection profiling enables one to ascertain whether or not fluids are being injected into all the desired intervals and at the optimum rates to enable improved extraction of hydrocarbons from the reservoirs. Accurate injection profiling is critical, not only for optimizing hydrocarbon recovery, but also for long-term reservoir management. It enables operators to diagnose any losses in reservoir injectivity, build-up of skin, and near-wellbore fractures. As a result, it may trigger operators to make configuration, operational or maintenance adjustments based on the determinations of the zonal injection volumes. Injection profiling can also influence important design considerations, such as, the design of subsurface completion, optimal well-placement and operating schedules.

In cased-hole injector wells, the injection profiling is generally performed through an operation called "production logging". In this operation, a spinner flow-meter is lowered down the wellbore tubing using a wireline tool. The speed of rotation of the spinner blades is assumed to be proportional to the velocity of the fluid passing through the area swept by the blades, with appropriate corrections for frictional effects and other departures from ideal spinner behavior. The spinner's average rotation speed is recorded as it crosses different injection zones, and is then used to estimate the zonal injection profile of the injection well. Notwithstanding its widespread use, production logging is hardly infallible; the spinner can stop rotating due to friction, provide inaccurate readings due to mechanical damage or changes in the injection fluid's viscosity or density, and the logging results critically depend on accurate tool calibration and depth control. Moreover, in some multi-tubing wellbore configurations, such as concentric tubing completions, running a production logging tool down the larger tubing is infeasible, unless the inner tubing string is removed from the wellbore. Finally, production logs are expensive and are thus typically employed to diagnose well problems, and are not readily adaptable for frequent, real-time or continuous zonal flow rate surveillance.

Another method for injection profiling utilizes thermal tracer techniques. Details of such related methods are described in "Determination of Water Injection Zonal Allocation from Distributed Temperature Sensing Data", Mehtiyev, N., Rahman, M., & Bourgoyne, D. A., *SPE Western Regional Meeting, Society of Petroleum Engineers* (2012), as well as in "Real-time Fluid Distribution Determination in Matrix Treatments using DTS", Glasbergen, G., Gualtieri, D., Van Domelen, M. S., & Sierra, J., *SPE Production & Operations,* 24(01), 135-146 (2009), both of which are incorporated herein by reference.

The thermal tracer method relies on tracking the movement of a tracer slug along the wellbore with a temperature signature distinct from the rest of the injected fluid. Due to fluid injection into the reservoir layers, the speed of the tracer slug changes as it crosses the different reservoir zones. The speed of the slug at different depths can be used to determine the instantaneous volumetric flow rate of fluid injected into each zone. Thermal tracer techniques demand high frequency measurements of the wellbore temperature profile in order to reliably track the motion of the tracer slug. This becomes particularly important as the slug crosses different pay zones. In practice, the temperature signature of the tracer slug diffuses both along the wellbore due to fluid mixing and over time due to heat exchange between the injected fluid and the surrounding rock. This makes the tracer temperature signature difficult to track, leading to inaccurate injection profiling. Additionally, the injection profile obtained from this thermal tracer technique is an instantaneous measurement and does not depict long-term injection accurately.

Another technique that uses wellbore temperature logs for injection profiling is the Conventional Warmback Analysis method which is based on the changes to the injection wellbore temperature profile during a shut-in that follows a period of steady-state injection. The Conventional Warmback Analysis method is described in 'The Estimation of Water Injection Profiles from Temperature Surveys', Nowak T. J., *Petroleum Transactions* (1953), which is incorporated herein by reference. This method involves the steps of measuring the wellbore temperature profile during steady injection, and the transient wellbore temperature profile during the shut-in immediately following the injection. In addition to these measurements, the following inputs are required for a typical software package that can carry out the Conventional Warmback Analysis:

a. The static well geometry,
b. Reservoir zonal depths and corresponding thicknesses,
c. The time of shut-in,
d. The "Reference Temperature Profile (RTP)" for the injection well, set as the Geothermal Temperature Profile in the Conventional Warmback Analysis.

In cases where the injection fluid is pumped at a temperature close to that at the Earth's surface, the temperature of the injected wellbore fluid is typically lower than that of the surrounding formation rock. This is because the injected fluid does not heat up all the way to the temperature of the formation rock due to forced convection. Once the well is shut-in, the injection fluid, now stagnant in the wellbore, gradually heats up due to ambient heat transfer with the surrounding rock. This process of heat transfer is termed "warmback". The Reference Temperature Profile is an estimate of the asymptotic temperature profile attained by the wellbore fluid during the shut-in. The Conventional Warmback Analysis method sets the Reference Temperature Profile as the Geothermal Temperature Profile. It estimates the cumulative injection volumes at different intervals based on the relative rates at which the wellbore fluid warms back to the Reference Temperature. In general, slower the warmback in a zone, greater was the volume of fluid injected into that zone over the preceding injection period. FIG. 1 illustrates a general timeline of the warmback method, depicting the steady state fluid injection and injection well shut-in time periods as a function of time.

FIG. 2A together with FIG. 2B illustrates aspects of the Conventional Warmback Analysis method, with FIG. 2A providing a simplified view of an injection well 201 which has been installed from the surface 205 through an overburden rock 210 through two pay zones (or "zones") 215 and 220 that are located in a hydrocarbon reservoir containing recoverable hydrocarbons. Zones 215 and 220 are also separated by a relatively (substantially) impermeable layer 225, such as shale rock. The injection well 201 is connected to an injection network 230 which supplies an injection fluid to the injection well 201. FIG. 2B illustrates the various depth and temperature profiles involved in performing the Conventional Warmback Analysis for the injector well 201 shown in FIG. 2A.

In FIG. 2B, Curve A illustrates a steady state injection temperature profile for the injection well shown in FIG. 2A that may be detected using an appropriate temperature measurement technique that may include, but is not limited to, fiber-optic Distributed Temperature Sensing (DTS), flux measurement, and Production Logging Tools (PLT). Curve B illustrates a shut-in temperature profile that may be similarly measured. This shut-in temperature profile is typically taken when the well is shut-in following a period of steady injection corresponding to Curve A. Curve C illustrates the Reference Temperature Profile used in the Conventional Warmback Analysis method calculations. As prior noted, in the Conventional Warmback Analysis method, the Reference Temperature Profile is set as the Geothermal Temperature Profile.

The Geothermal Temperature Profile can be obtained in many ways; for example, a. as the Earth's natural equilibrium temperature profile measured when the first well is brought into injection or production in a greenfield;
b. through Formation Evaluation interpretations during the exploration phase of the field.

The Geothermal Temperature Profile is set as the Reference Temperature Profile for any subsequent plurality of Conventional Warmback Analysis calculations that may be conducted across the lifetime of the field. Inflection $B_1$ in the shut-in temperature profile B illustrates the lower temperature in the upper pay zone 215, while inflection $B_2$ in the shut-in temperature profile illustrates the lower temperature in the lower pay zone 220. The extent of the inflections $B_1$ and $B_2$ are indicators of the cumulative injection volume taken by zones 215 and 220 in the preceding injection cycle—greater the extent of inflection, greater the total injected volume into that zone. Hereafter, inflections $B_1$ and $B_2$ may sometimes be referred to as "warmback signatures".

FIG. 1 provides an illustration of injection rate vs. time for the various stages of an injection cycle in order to perform a warmback analysis. $t_1$ is a period of steady injection of the well. Following this steady injection period, the injector well needs to be shut-in so as to perform the analysis. The time windows indicated by $t_2$ and $t_3$ together represent periods of shut-in following the steady injection $t_1$. When the well is injecting in steady-state, the surroundings of the well comprising both the overburden and the pay zones are at the steady injection temperature. The period $t_2$ denotes the time period during which warmback signatures appear on the wellbore temperature profile (as illustrated by the inflections in the temperature profile as designated as $B_1$ and $B_2$ in FIG. 2B). The point in time designated as 101 in FIG. 1 denotes when the point in time when the temperature signature transitions from period $t_2$ to period $t_3$. During the period $t_3$, the warmback signatures gradually disappear. The interval $t_3$ ends when the warmback signatures completely disappear or the operator believes that sufficient data has been collected for input to the Conventional Warmback Analysis method. The time period $t_4$ in FIG. 1 illustrates when the injection well is back into a steady state injection mode following its shut-in.

This Conventional Warmback Analysis method, as currently used in the art, may not produce accurate results or be able to properly model certain conditions in mature reservoirs. Therefore, improved processes for using the warmback method are needed in the art.

SUMMARY

An embodiment disclosed herein is a method of estimating the relative cumulative volume of fluids injected into multiple zones of an injection well located in a hydrocarbon reservoir, comprising:

a) determining an injection period for the injection well when the injection well is injecting at least one injection fluid under steady state conditions;

b) inputting the geometry of the injection well into a processor containing a Conventional Warmback Analysis software package;

c) inputting the depths of the multiple zones of the hydrocarbon reservoir and the overburden of the hydrocarbon reservoir into the processor;

d) recording an injection temperature profile for the injection well during the injection period;

e) shutting in the injection well for a first shut-in period;

f) monitoring the temperature profile of the injection well during the first shut-in period and identifying a time coincident with the appearance of warmback signatures at the multiple zones;

g) recording an initial shut-in temperature profile of the injection well at a time coincident with the appearance of warmback signatures at reservoir depths during the first shut-in period and ending the first shut-in period;

h) continuing to monitor the temperature profile of the injection well after step g) during a second shut-in period and identifying a time coincident with the disappearance of warmback signatures at the multiple zones;

i) recording a long-term shut-in temperature profile of the injection well at a time coincident with the disappearance of warmback signatures at the multiple zones during the second shut-in period and ending the second shut-in period;

j) inputting the initial shut-in temperature profile as a shut-in temperature profile into the processor;

k) inputting the long-term shut-in temperature profile as a reference temperature profile into the processor;

l) inputting the duration of the first shut-in period and the duration of the second shut-in period into the processor;

m) analyzing the information input into the processor from the prior steps utilizing the Conventional Warmback Analysis software package;

n) obtaining computational results from the Conventional Warmback Analysis software package; wherein the computational results comprise relative cumulative fluid injection profiles along the injection well for the injection period.

Another embodiment disclosed herein is a method of estimating the relative cumulative volume of fluids injected into multiple zones of an injection well located in a hydrocarbon reservoir, comprising:

a) determining an injection period for the injection well when the injection well is injecting at least one injection fluid under steady state conditions;

b) inputting the geometry of the injection well into a processor containing a Conventional Warmback Analysis software package;

c) inputting the depths of the multiple zones of the hydrocarbon reservoir and the overburden of the hydrocarbon reservoir into the processor;

d) recording an injection temperature profile for the injection well during the injection period;

e) shutting in the injection well for a first shut-in period;

f) monitoring the temperature profile of the injection well during the first shut-in period and identifying a time coincident with the appearance of warmback signatures at the multiple zones;

g) recording an initial shut-in temperature profile of the injection well at a time coincident with the appearance of warmback signatures at reservoir depths during the first shut-in period and ending the first shut-in period;

h) continuing to monitor the temperature profile of the injection well after step g) during a second shut-in period and identifying a time coincident with the disappearance of warmback signatures at the multiple zones;

i) calculating multiple long-term shut-in temperatures at multiple depths of the injection well, y, by utilizing a statistical toolbox to asymptotically extrapolate the temperatures of the monitored shut-in temperature profile in step h) by fitting a model that describes the exponential behavior of the wellbore temperature at each of the multiple depths by using the equation:

$$T_{LTSIT}-T_{shutin}(t)=(T_{LTSIT}-T_{inj})e^{-\lambda t},$$

wherein $T_{LTSIT}$, $T_{shutin}$ and $T_{inj}$ refer to the long-term shut-in temperature, the shut-in temperature and the injection temperature at the selected depth, respectively, t indicates the time elapsed since the well was shut-in, and $\lambda$ represents the rate of exponential warm-up of the wellbore to the long-term shut-in temperature;

j) combining the multiple asymptotically extrapolated temperatures at each of the multiple depths to form a long-term shut-in temperature profile;

k) inputting the initial shut-in temperature profile as a shut-in temperature profile into the processor;

l) inputting the long-term shut-in temperature profile as a reference temperature profile into the processor;

m) inputting the duration of the first shut-in period and the duration of the second shut-in period into the processor;

n) analyzing the information input into the processor from the prior steps utilizing the Conventional Warmback Analysis software package; and o) obtaining computational results from the Conventional Warmback Analysis software package; wherein the computational results comprise relative cumulative fluid injection profiles along the injection well for the injection period.

Another embodiment disclosed herein is a method, of any one of the embodiments described above, further comprising:

determining either the appearance of a warmback signature or the disappearance of a warmback signature by:

solving a pure heat conduction problem between the wellbore and the surrounding rock fixed at a long-term shut-in temperature profile without considering any injection effects, wherein at any overburden depth (indicated by superscript ob), wherein the shut-in temperature satisfies the equation:

$$T_{LTSIT}^{ob}-T_{shutin}^{ob}(t)=(T_{LTSIT}^{ob}-T_{inj}^{ob})e^{-\lambda t},$$

wherein $T_{LTSIT}^{ob}$, $T_{shutin}^{ob}$ and $T_{inj}^{ob}$ refer to the long-term shut-in temperature, shut-in temperature and the injection temperature at the selected overburden depth, respectively, t indicates the time elapsed since the shut-in of the injection well, and $\lambda$ represents the rate of exponential warm-up to the long-term shut-in temperature, at the overburden depth;

empirically estimating the exponential coefficient $\lambda$ by plotting the difference $T_{LTSIT}^{ob}-T_{shutin}^{ob}(t)$ on a semi-logarithmic scale against time t at various times during the shut-in, fitting a straight line through the resulting data points, and estimating the coefficient $\lambda$ as the negative slope of the fitted straight line; and calculating the multiple extrapolated shut-in temperatures for at least one pay zone of the injection well (indicated by $T_{extrap\text{-}shutin}^{pz}(t)$) by the formula:

$$T_{extra\text{-}shutin}^{pz}(t)=T_{LTSIT}^{pz}-(T_{LTSIT}^{pz}-T_{inj}^{pz})e^{-\lambda t};$$

determining the difference between each of the calculated extrapolated shut-in temperatures and the temperatures of the monitored temperature profiles for the at least one pay zone;

determining the appearance of a warmback signature or disappearance of a warmback signature if the difference between at least a portion of the temperatures of the monitored temperature profile for the at least one pay zone and their associated calculated extrapolated shut-in temperatures for the at least one pay zone is greater than a threshold value for the appearance of a warmback signature, or is less than a threshold value for the disappearance of a warmback signature.

Another embodiment disclosed herein is a method for determining, for planning purposes, the duration of a subsequent injection schedule for an injection well located in a hydrocarbon reservoir, comprising:

During a first cycle, performing the steps comprising:

1a) shutting in the injection well;

1b) establishing a long-term shut-in temperature of the injection well;

1c) starting injection of an injection fluid into the injection well at a known rate for a short period of time, $q_{base}$;

1d) measuring and recording the period of injecting the injection fluid in step 1c) as $t_{1\ base}$;

1e) stopping the injection of the injection fluid and shut in the injection well;

1f) measuring and recording the time for the appearance of the warmback signatures as $t_{2_base}$;

1g) measuring and recording the time for the disappearance of the warmback signatures as $t_{3_base}$; and Determining the durations of the subsequent injection schedule by performing the steps comprising:

2a) beginning re-injection of the injection fluid into the injection well in normal operations for a period of time, $t_4$;

2b) measuring and recording the total cumulative amount of the injection fluid that has been injected during the period $t_4$ as Q;

2c) determining, for planning purposes, the duration in the subsequent injection schedule for the warmback traces to appear as $t_{2_base}$ and the durations in the subsequent injection schedule for the warmback traces to disappear as $t_{3_base}$ from the following equations:

$$t_{2_plan} = t_{2_base}\left(\frac{Q}{t_{1_base}\times q_{base}}\right)$$

$$t_{3_plan} = t_{3_base}\left(\frac{Q}{t_{1_base}\times q_{base}}\right)$$

BRIEF DESCRIPTION OF THE DRAWINGS

The advantages of the present techniques are better understood by referring to the following detailed description and the attached drawings, in which.

DETAILED DESCRIPTION OF THE EMBODIMENTS

Figure 1:
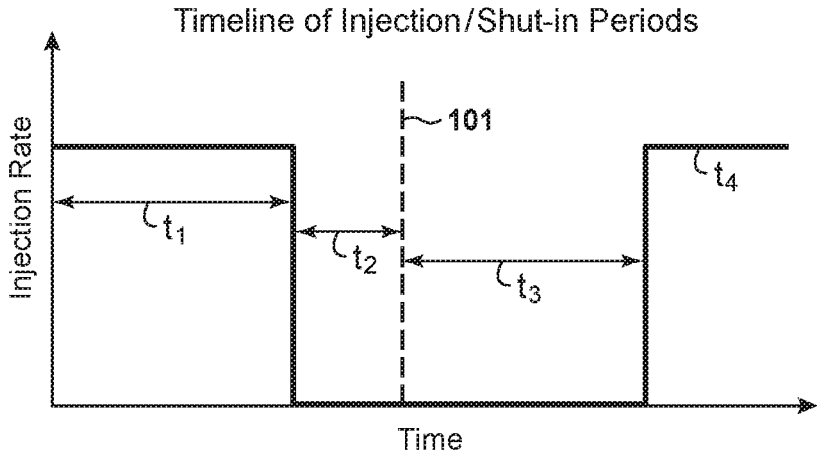
FIG. 1 is an illustration of the typical timeline of the steady state injection and shut-in time periods for an injection well as utilized in the Conventional Warmback Analysis method.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

The processes and methods herein provide a new method for determining zonal flow rates from an injection well injecting into a multi-layer hydrocarbon reservoir using distributed temperature measurements that mitigates the limitations and issues of the prior art described above.

It has been discovered by the authors herein that the Conventional Warmback Analysis method described in the prior art is generally accurate in profiling injector wells in Greenfield reservoir applications (i.e., new or early-life reservoirs). However, Conventional Warmback Analysis often produces inaccurate estimates of the zonal flow rates when applied to Brownfields (e.g., mature or late-life reservoirs). It has been found that these inaccuracies appear to be tied to the assumption in the prior art that the Geothermal Temperature Profile remains a valid choice for the Reference Temperature Profile for the analysis over the entire life of the reservoir or injection well. It has been found that as a reservoir evolves further into its production cycle, prolonged injection causes the temperature and the thermal properties of the surrounding formation to gradually change. Consequently, the Geothermal Temperature Profile becomes increasingly irrelevant to the warmback process and it has been discovered herein that its choice/use for the Reference Temperature produces inaccurate results from the Conventional Warmback Analysis. The Conventional Warmback Analysis hinges on the assumption that the wellbore shut-in temperature profile asymptotes to the Geothermal Temperature Profile. However, it has been discovered that in the case of mature reservoirs, the wellbore fluid does not warm back all the way to the Geothermal Temperature Profile even after extended shut-ins of several months to several years. As a result, the use of the Geothermal Temperature Profile as the Reference Temperature Profile in a Conventional Warmback analysis well result in inaccurate flow profiling of the reservoir.

One of the embodiments of the present invention enables profiling wells in mature reservoirs wherein the injection temperature profile is strictly lower than or equal to the Long-Term Shut-In Temperature Profile, as the term as defined herein. In this embodiment, the Long-Term Shut-In Temperature Profile is utilized as the Reference Temperature Profile in a Conventional Warmback Analysis method with the Long-Term Shut-In Temperature directly enables use of Conventional Warmback Analysis approaches to obtain a more accurate injection profile.

In an embodiment, the appearance and disappearance of these warmback signatures may be determined by calculating an "Extrapolated Shut-In Temperature Profile". The Extrapolated Shut-In Temperature Profile refers to the shut-in temperature profile that would have been attained in the wellbore upon shut-in, had no injection occurred in the pay zones 215 and 220. The Extrapolated Shut-In Temperature Profile is calculated by solving a pure heat conduction problem between the wellbore and the surrounding rock fixed at the Long-Term Shut-In Temperature Profile, without considering any injection effects. At any overburden depth (indicated by superscript ob), the shut-in temperature satisfies the equation:

$$T_{LTSIT}^{ob}-T_{shutin}^{ob}(t)=(T_{LTSIT}^{ob}-T_{inj}^{ob})e^{-\lambda t} \quad \text{(Eq. 1)}$$

where $T_{LTSIT}^{ob}$, $T_{shutin}^{ob}$ and $T_{inj}^{ob}$ refer to the Long-Term Shut-In Temperature, the shut-in temperature (as a function of time) and the injection temperature at the selected overburden depth, t indicates the time elapsed since the well was shut-in, and A represents the rate of exponential warm-up of the wellbore to the long-term shut-in temperature. In Eq. 1, all variables are known except for the exponential coefficient λ. Thus, the exponential coefficient λ may be empirically estimated by plotting the difference $T_{LTSIT}^{ob}-T_{shutin}^{ob}(t)$ on a semi-logarithmic scale against time t at various times during the shut-in, and fitting a straight line through the resulting data points. The coefficient λ can then be estimated as the negative slope of the fitted straight line. In practice, the point chosen for the above procedure lies in a non-reservoir interval (e.g., 225) close to the pay zones. Next, the Extrapolated Shut-In Temperature at any pay zone depth (indicated by $T_{extrap\text{-}shutin}^{pz}(t)$) may be calculated by:

$$T_{extrap\text{-}shutin}^{pz}(t)=T_{LTSIR}^{pz}-(T_{LTSIT}^{pz}-T_{ink}^{pz})e^{-\lambda t} \quad \text{(Eq. 2)}$$

Figure 2A:
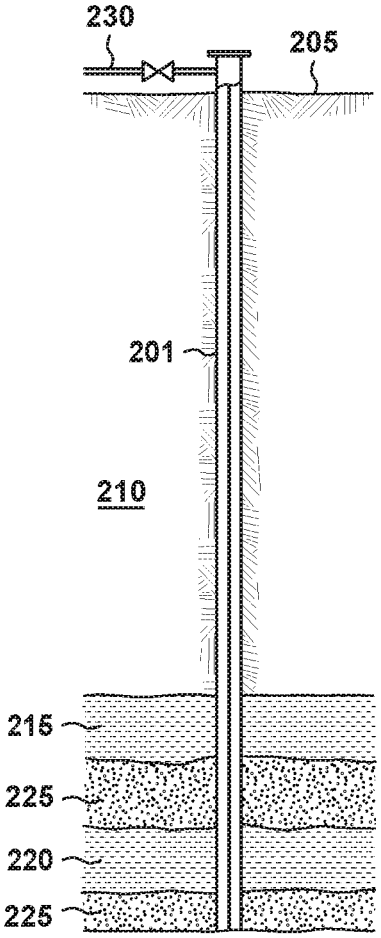
FIG. 2A is an illustration of a simplified view of an injection well illustrating exemplary layers of overburden, pay zones, and a relatively impermeable layer.
Figure 2B:
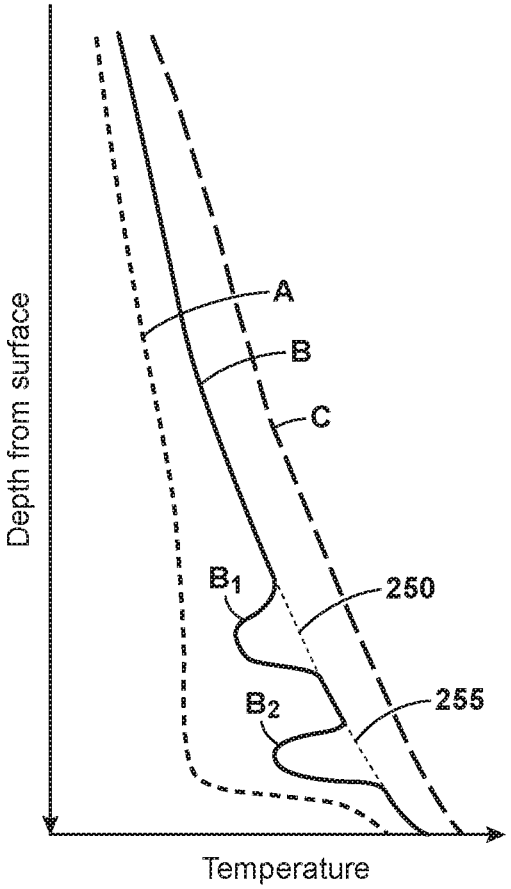
FIG. 2B is an illustration of a typical steady-state injection temperature profile, a shut-in temperature profile, and the Reference Temperature Profile (Geothermal Temperature Profile) for an injection well corresponding to the elevations and zones of FIG. 2A as pertains to the Conventional Warmback Analysis method.

The Extrapolated Shut-In Temperature calculated by the method associated with the pay zones 215 and 220 in FIG. 2A are illustrated by the dotted lines labeled 250 and 255 respectively in FIG. 2B. It is preferred that the overburden depth selected for these calculations be located at a point near, but not in, the payzone for which the Extrapolated Shut-In Temperature is being calculated. The first instance of a deviation between the Shut-In Temperature at a pay zone and the corresponding Extrapolated Shut-In Temperature (either in absolute terms (e.g. 1° F.) or in relative terms (e.g. 2% of temperatures in ° F.)) is referred to herein as "appearance of the warmback signatures". This deviation can be set by the user based on acceptable tolerances. In embodiments, this deviation between the Shut-In Temperature at a pay zone and the corresponding Extrapolated Shut-In Temperature can be less than 1° F., less than 5° F., less than 10° F., or less than 25° F. In other embodiments, this deviation between the shut-in temperature at a pay zone and the corresponding Extrapolated Shut-In Temperature can be less than 1%, less than 2%, less than 5%, or less than 10% based on temperatures in ° F. (with the Extrapolated Shut-In Temperature as the denominator). Following the appearance of the warmback signatures, the first instance of when the shut-in temperature at a pay zone no longer substantially deviates with the Extrapolated Shut-in Temperature is referred to as the "disappearance of the warmback signatures". This deviation can be set by the user based on acceptable tolerances. In embodiments, this deviation between the shut-in temperature at a pay zone and the corresponding Extrapolated Shut-In Temperature can be less than 1° F., less than 5° F., less than 10° F., or less than 25° F. In other embodiments, this deviation between the shut-in temperature at a pay zone and the corresponding Extrapolated Shut-In Temperature can be less than 1%, less than 2%, less than 5%, or less than 10% based on temperatures in ° F.

Figure 3:
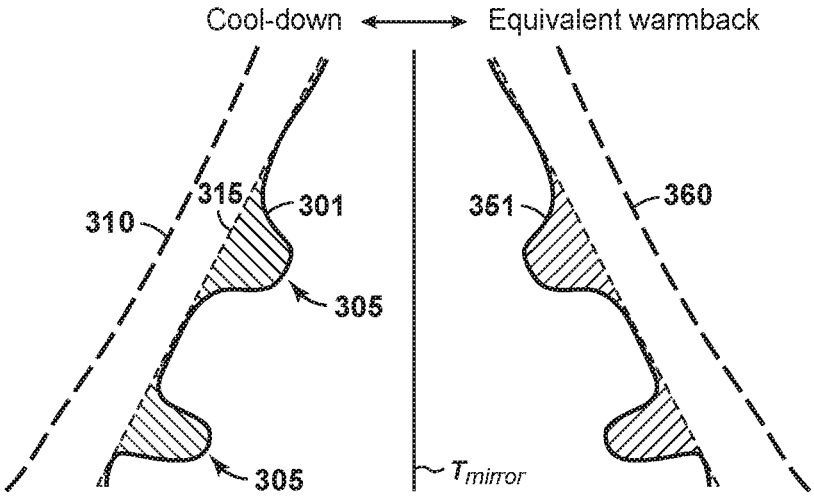
FIG. 3 is an illustration of an embodiment of the present invention illustrating the mirroring transformation technique.

While an extended shut-in period is the most ideal for obtaining the Long-Term Shut-in Temperature Profile for use within the present invention, it may not always be possible to shut-in the injector well for very long durations. In such cases, a preferred method for generating an accurate Long-Term Shut-in Temperature Profile $T_{LTSIT}$ (y)—across time is described as follows. While the foregoing discussion refers to a single depth "y", it should be understood that this method is applied to all the depth values (y) along the injection well to produce the overall Long-Term Shut-in Temperature Profile. In this method, the operator goes through the data acquisition steps as outlined with respect to FIG. 1. The period designated as $t_2$ is held long enough so that warmback and/or cooldown signatures appear in the wellbore temperature profile (as illustrated in FIG. 3, curve 301). The well is continued to be shut-in into time period $t_3$, as it asymptotes to the Long-Term Shut-in Temperature Profile $T_{LTSIT}$(y). During the time period $t_3$, the wellbore temperature profile should be recorded at multiple different times, until the operator deems sufficient data has been collected. Next, at each depth y, a statistical toolbox may be used to asymptotically extrapolate the recorded temperatures by fitting a model that describes the exponential behavior of the wellbore temperature as computed by:

$$T_{LTSIT}-T_{shutin}(t)=(T_{LTSIT}-T_{inj})e^{-\lambda t} \quad \text{(Eq. 3)}$$

where the terms are as similarly defined in Eq. 1, but pertain to any depth "y", either in a pay-zone, or the overburden.

Here, the unknowns to be solved for are the exponential coefficient λ, and the Long-Term Shut-in Temperature $T_{LTSIT}$. This process is repeated for different depths y to obtain an approximation to the Long-Term Shut-in Temperature Profile.

Another embodiment of the present invention is a "Hybrid Warmback Analysis" method that enables profiling in injection wells that inject fluids into reservoirs (including mature and sub-cooled reservoirs) wherein at least a portion of the injection temperature profile is warmer than the Long-Term Shut-In Temperature Profile at the corresponding depth. In particular, this includes reservoirs whose Long Term Shut-In Temperatures are significantly lower than the Geothermal Temperature, and reservoirs where hot fluids such as steam are injected. In these scenarios, even with the use of the Long-Term Shut-In Temperature as the Reference Temperature, Conventional Warmback Analysis methods will yield incorrect injection profiles. These inaccuracies arise from the inability of the Conventional Warmback Analysis to address the situation where a part of the wellbore warms up to the Reference Temperature and a part of the wellbore cools down to the Reference Temperature. Often, the portions that cool down are assigned zero rates resulting in incorrect cumulative injection profiles. This error is compounded by the fact that the remaining warmback zones are allocated the volumes that correspond to the cool-down zones.

This Hybrid Warmback Analysis method comprises a temperature profile pre-processing step that enables the use of Conventional Warmback Analysis approaches in the aforementioned scenario. The inputs to the pre-processing step are:

a. Long-Term Shut-In Temperature Profile for the wellbore measured following the most recent long-term shut-in, set as the Reference Temperature in the Hybrid Warmback Analysis,
b. Injection temperature profile measured as the wellbore temperature profile during a time of steady injection (e.g. $t_1$ in FIG. 1), and
c. A time-series of wellbore temperature profiles measured following a shut-in that follows a steady injection period (e.g. $t_2$ in FIG. 1).

This novel pre-processing step transforms all the inputted temperature profiles in such a way that the transformed temperature profiles together with static well geometry, reservoir depths, and reservoir thickness can be used with a Conventional Warmback Analysis method to obtain accurate injection profiles. During the pre-processing step, the parts of the wellbore temperature profile that exhibit a cooldown (upon shut-in) are "mirrored" across a reference mirroring temperature, $T_{mirror}$. The parts of the wellbore temperature profile exhibiting warmback are left unmodified. This is illustrated in FIG. 3 where at least a portion of the shut-in temperature profile 301 reflects at least one "reverse" (or positive) temperature inflection, illustrated in two zones/locations as 305 in FIG. 3. In this illustration, even though not a requirement of the Hybrid Warmback Analysis method herein, the Long Term Shut-In Temperature is used as the Reference Temperature Profile 310.

An approach to selecting $T_{mirror}$ is the "pivoting approach" described as follows. $T_{mirror}$ may be selected as the temperature at the point nearest to the cool-down zone at which the Long-Term Shut-In Temperature profile and the shut-in temperature profile coincide (i.e., have the same value). The value of $T_{mirror}$ may be held uniformly constant across all cool-down zones, or chosen separately for each one as illustrated as elements $T_{mirror\ 1}$ and $T_{mirror\ 2}$ in FIG. 4B. If a uniform value is selected, $T_{mirror}$ may preferably be selected as any temperature greater than the shut-in temperatures 301 at the cool-down zones.

The pre-processing step is further illustrated by continuing with FIG. 3 wherein the left side of the figure illustrates the cooldown temperature profile data obtained at the end of the shut-in period $t_2$ as described in FIG. 1 and the elements as described in the description for FIG. 3 above. Here the shut-in temperature profile 301 for these cooldown zones is mathematically mirrored using $T_{mirror}$ selected using the pivoting approach. The mathematical transformation to obtain the mirrored shut-in temperature profile 351 is described by Equation 5. A similar transformation (Eq. 6) is used to pre-process the Reference Temperature Profile 310 to obtain the mirrored Reference Temperature Profile 360. While not illustrated in FIG. 3, a similar approach (Eq. 4) is also used to pre-process the steady state injection temperature profile.

The pre-processing step leverages the fact that the process of cooldown of zones warmer than the Long-Term Shut-In Temperature Profile (see FIG. 3) is governed by the same physical principles and equations as the portions of the wellbore temperature profile that experience a warmback. The pre-processing step converts each of the input temperature profiles to a pre-processed set of temperature profiles such that each portion of the pre-processed temperature profiles uniformly exhibits a mathematically equivalent warmback, i.e., a warmback with the same injection profile as the original setup.

The conversion (pre-processing) of a cooldown process into an equivalent warmback process is accomplished in the pre-processing step through the mathematical transformations (Eqs. 4-6), carried out only at depths where the steady injection fluid temperatures are lower than the Long Term Shut-In Temperature. Recall that for a Hybrid Warmback Analysis, the Reference Temperature is set as the Long Term Shut-In Temperature.

$$T_{inj\text{-}mirrored}(y)=2T_{mirror}-T_{inj}(y) \quad \text{(Eq. 4)}$$

$$T_{shutin\text{-}mirrored}(y)=2T_{mirror}-T_{shutin}(y) \quad \text{(Eq. 5)}$$

$$T_{ref\text{-}mirrored}(y)=2T_{mirror}-T_{ref}(y) \quad \text{(Eq. 6)}$$

where, $T_{inj}(y)$ is the temperature of the wellbore at depth y during steady injection.

$T_{inj\text{-}mirrored}(y)$ is the calculated mirrored injection temperature of the wellbore at depth y.

$T_{shutin}(y)$ is the temperature of the wellbore at depth y measured during the shut-in following the injection period in which $T_{inj}(y)$ was observed.

$T_{shutin\text{-}mirrored}(y)$ is the calculated mirrored shut-in temperature at depth y.

$T_{ref}(y)$ is the Reference Temperature of the well measured at vertical depth y.

$T_{ref\text{-}mirrored}(y)$ is the calculated mirrored Reference Temperature of the well at depth y.

$T_{mirror}$ is the reference mirroring temperature selected for the current cool-down zone.

Figure 4A:
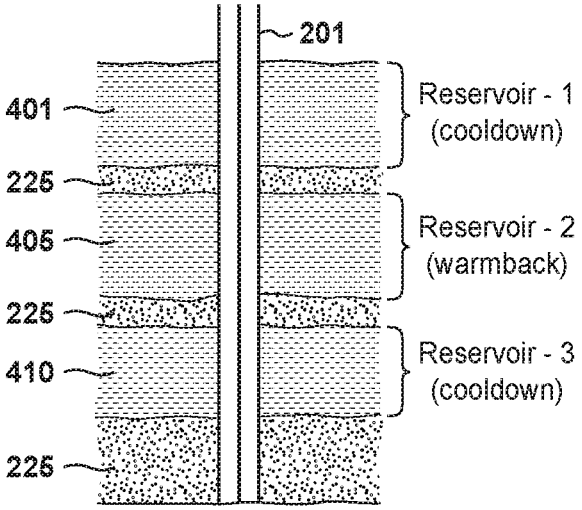
FIG. 4A is an illustration of a simplified view of an injection well illustrating the exemplary layers of three (3) pay zones and three (3) relatively impermeable layers wherein two (2) of the pay zones exhibit non-standard "cooldown" behavior during a shut-in following a steady injection period, and a third intermediate pay zone exhibits typical warmback behavior.
Figure 4B:
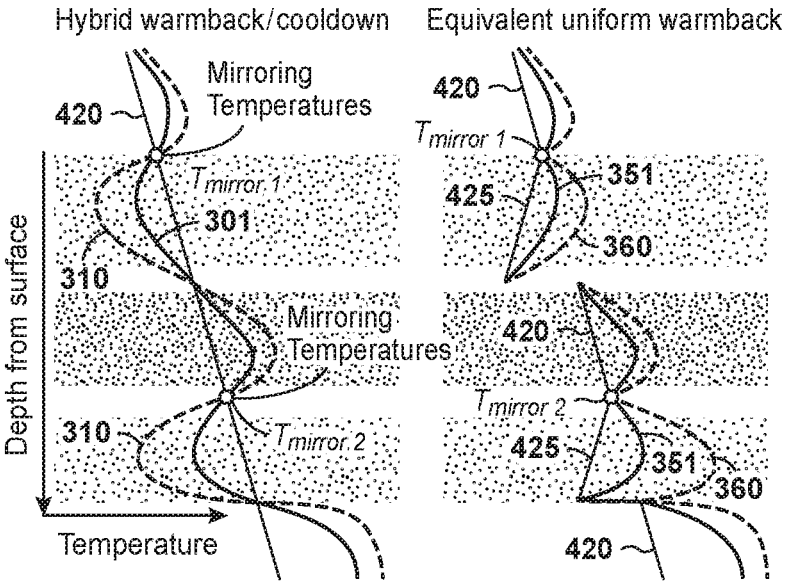
FIG. 4B is an illustration of an embodiment of the present invention illustrating the mirroring transformation technique, wherein on the left side of the figure is an illustration of a steady state injection temperature profile, a shut-in temperature profile when the warmback/cooldown signatures have appeared, and a Reference Temperature profile for an injection well corresponding to the elevations of FIG. 4B prior to profile transformations. On the right side of the figure is an illustration of the steady state injection temperature profile, the shut-in temperature profile, and the Reference Temperature profile for an injection well corresponding to the elevations of FIG. 4B after the temperature profile transformations described herein.

As noted above, these mathematical transformations, depicted in FIG. 3, are equivalent to mirroring the temperature profiles $T_{inj}(y)$, $T_{shutin}(y)$, $T_{ref}(y)$ around the selected mirror temperature $T_{mirror}$. Upon completing the above transformations, the resulting temperature profiles $T_{inj\text{-}mirrored}(y)$, $T_{shutin\text{-}mirrored}(y)$ and $T_{ref\text{-}mirrored}(y)$ represent an equivalent warmback process for the corresponding cooldown zone, with an injection profile identical to the original setup. In the Hybrid Warmback Analysis herein, these mirrored temperature profiles are then utilized as part of the temperature profiles for the Conventional Warmback Analysis method to accurately predict the relative cumulative injection volumes allocated to these cooldown zones. Furthermore, if the total volume of fluid injected in the injection cycle is known (e.g., through measurements of a surface flow meter or a model), the above process improves the accuracy of estimating the absolute zonal injection volumes in both warmback and cooldown regions. FIGS. 4A and 4B, described further below, will further illustrate how to produce a Long-Term Shut-In Temperature Profile based on this Hybrid Warmback Analysis method herein for use as the Reference Temperature Profile in a Conventional Warmback Analysis method.

It should also be noted that the methods described herein can be applied to any of the following scenarios:

a. injection wells with cooldown zones only (such as those in mature and sub-cooled reservoirs),
b. injection wells with a combination of cooldown zones and warmback zones,
c. injection wells with warmback zones only.

It should be understood that when used with injection wells exhibiting both cooldown and warmback zones, the mirroring technique described herein should only be applied to the cooldown zones.

The Hybrid Warmback Analysis method is further illustrated in FIGS. 4A and 4B. FIG. 4A shows an illustration of an injection well similar to that in FIG. 2, except here, three pay zones 401, 405 and 410 containing recoverable hydrocarbons which (as illustrated here) are located in a hydrocarbon reservoir and are separated by relatively impermeable layers 225, such as shale rock. In this example, zones 401 and 410 exhibit cooldown behavior, and the intermediate zone 405 exhibits warm-up behavior when the well is shut-in after a period of injection. It should also be noted that while, for illustration purposes only, FIG. 4A illustrates a substantially vertical injection well, the methods here can be used in any injection well orientation such as inclined (deviated) wells or horizontal wells, as long as the temperature profiles are taken and analyzed over the length (instead of solely vertical depth as shown in FIGS. 2A/B and 4A/B) of the injection well. The methods described herein are preferably utilized for the analysis of substantially vertical or deviated wells (up to 85 degrees inclination).

The left hand side of FIG. 4B illustrates the temperature profiles as measured during the testing as described in FIG. 1. The right hand side of FIG. 4B illustrates the temperature profiles as transformed after the pre-processing step of the Hybrid Warmback Analysis, in accordance with the methods herein. For cooldown zones 401 and 410, the corresponding temperature profiles and transformations are shown on the left hand side and right hand side of FIG. 4B respectively. The mirrored steady state injection temperature profiles $T_{inj\text{-}mirrored}(y)$, the mirrored shut-in temperature profile $T_{shutin\text{-}mirrored}(y)$, and the mirrored Reference Temperature profile $T_{ref\text{-}mirrored}(y)$ are respectively labeled as 425, 351 and 360. As can be seen, in the left hand side of FIG. 4B, the shut-in temperature profile 301 for the zones 401 and 410 deviates negatively (i.e., exhibits a cooldown) from the steady state injection temperature profile 420 and that the surrounding formation in these zones is cooler than the injection temperature. The Reference Temperature profile $T_{ref}(y)$ 310 is also depicted. It may be determined using any of the approaches previously described.

For the cooldown zones 401 and 410, suitable values of $T_{mirror}$ are selected and the transformed temperature profiles from Equations 3-5 for these zones is illustrated on the right hand side of FIG. 4B. In particular, as can be seen in FIG. 4B, different values of $T_{mirror}$ are selected for zone 401 (shown in FIG. 4 as $T_{mirror\ 1}$) and zone 410 (shown in FIG. 4 as $T_{mirror\ 2}$). As can be seen in the left hand side of FIG. 4B, the shut-in temperature profile 301 for zone 405 deviates positively (i.e., warm-up) from the steady state injection temperature profile 420 indicating that the Reference Temperature of the surrounding formation in this zone is greater than the injection temperature. As such, no transformation (mirroring) is required for this zone as is reflected on the right hand side of FIG. 4B. The resulting mirrored data for the cooldown zones 401 and 410 are combined with the data as obtained from the warm-up zone 405 to create the combined reservoir profile on the right hand side of FIG. 4B which may then be inputted into the Conventional Warmback Analysis method.

Figure 5:
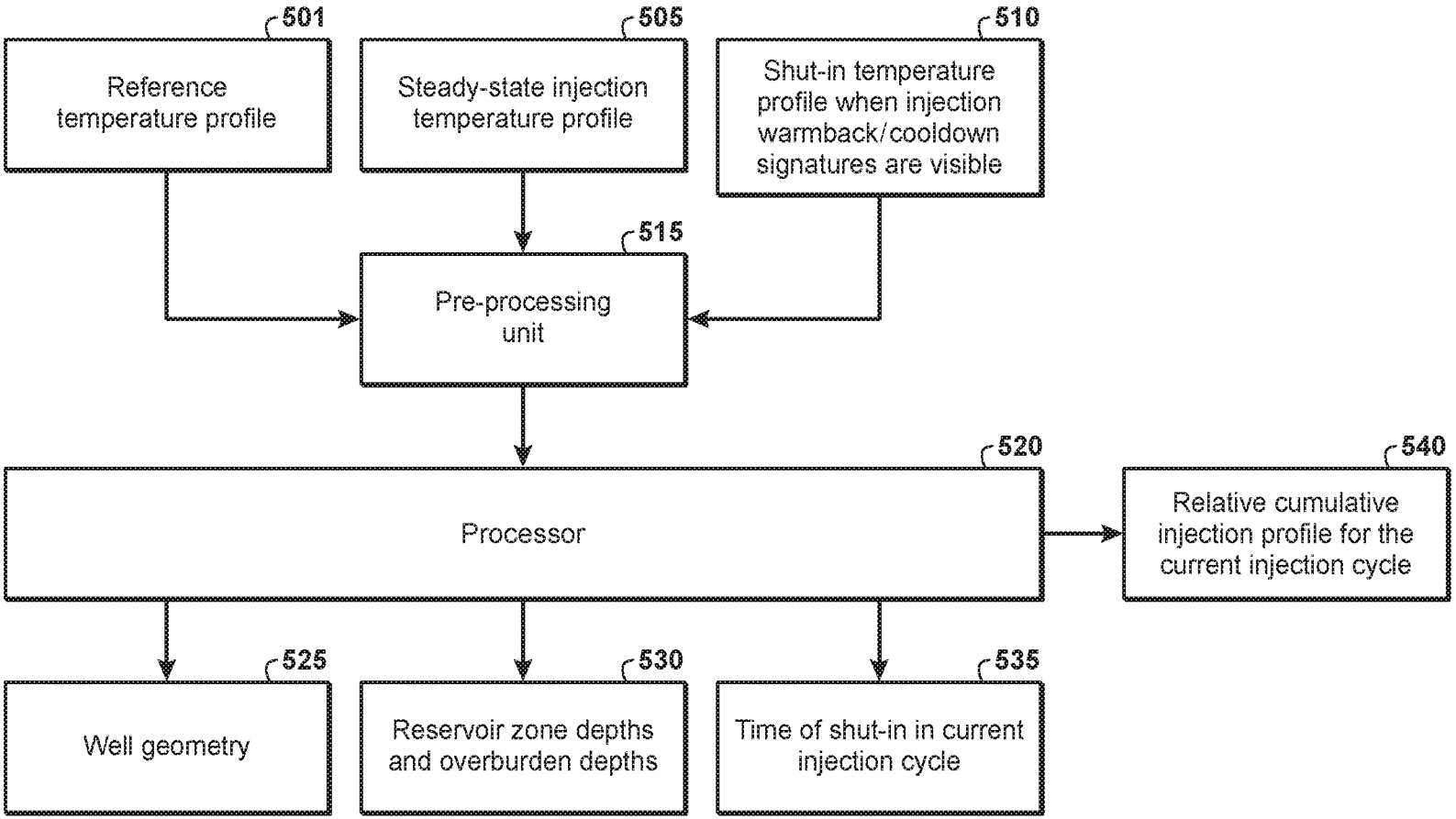
FIG. 5 is an illustration of an embodiment of a procedure/process, including the temperature profile transformations as described herein and utilized with the Conventional Warmback Analysis method as described herein.

FIG. 5 further illustrates such a procedure/process as has been described herein. In FIG. 5, while we may refer to each step in obtaining or executing a singular value (such as "Reference Temperature"), such steps may apply to obtaining or executing multiple values or profiles derived from a multiple value analysis. In FIG. 5, the Reference Temperature profile 501, steady-state injection temperature profile 505 and the shut-in temperature profile 510 as described in the above processes are input into a pre-processing step 515 (which may be part of or a function within processor 520). The pre-processing unit 515 transforms the data as per the processes above, and in zones where the pre-processing unit identifies a cooldown (instead of the typical warm-up), the preprocessing unit executes the mirroring techniques discussed herein to transform the data (i.e., mirror the Reference Temperature profile, steady-state injection temperature profile and the shut-in temperature profile) for use with the Conventional Warmback Analysis. The output of the preprocessing unit 515 includes the transformed data from cooldown zones or a combination of non-transformed data from warm-up zones with transformed data from cooldown zones is input into a processor 520 running the Conventional Warmback Analysis method. Other supplemental information, which is relevant to running the Conventional Warmback Analysis method, such as well geometry 525, reservoir zone depths and thicknesses, and overburden depths 530, and time of shut-in in the current injection cycle 535 is also input into the Conventional Warmback Analysis. A relative cumulative injection profile 540 of the current injection cycle for the injection well is output from the Conventional Warmback Analysis.

The result of the Hybrid Warmback Analysis method is an injection profile along the length of the well. This information will then be used to determine whether adequate voidage is being replaced in each of the reservoirs. For wells equipped with ability to shut-off or control injection into certain zones through inflow control valves, injection profiles from warmback analysis can be used to manage voidage replacement. Also, results from the Hybrid Warmback Analysis may be used in informed History Matching of a simulation of the reservoir to further assess the efficacy of the sweep and to make operational decisions on infill drilling. The results of the Hybrid Warmback Analysis disclosed herein may be utilized to facilitate the extraction of hydrocarbons from a reservoir. Moreover, the injection profile resulting from the present invention can be used in studies to ascertain the structural integrity of the rock (i.e., whether the formation has been fractured) and adjust zonal flow rates accordingly. Alternatively or additionally, in embodiments herein, the results of the warmback analysis disclosed herein may be used to performing at least one or more of the following actions based on the computational results:

- initiate, cease, increase, or decrease a flow rate of the injection fluid from the injection well or from another injection well located in the reservoir;
- initiate, cease, increase, or decrease the flow or flow rate of a production fluid from a production well located in the reservoir;
- modify the injection pattern of the injection fluid along the well;
- install or reactivate an additional well in the reservoir;
- change injection pressure at the well head;
- shut in flow to certain zones and/or open certain zones;
- change the schedule of the injection cycle;
- take the injection well or another existing well in the reservoir out of service;
- apply a maintenance procedure to the well; and
- adjust the composition, temperature or pressure of the injection fluid.

FIG. 1 illustrates a typical injection schedule required to perform the present Hybrid Warmback Analysis. The duration of shut-in times $t_2$ and $t_3$ required for the warmback signatures to appear and gradually disappear, depend on the net volume of fluid injected during the injection phase $t_1$. The rate of relaxation to the Reference Temperature is inversely proportional to the amount of injection fluid taken by that zone. Therefore, higher rates of injection or injection durations $t_1$ demand longer shut-in durations $t_2$ and $t_3$ to enable accurate profiling. The entire duration including $t_1$, $t_2$, and $t_3$ is called an "injection schedule". To effectively perform the Hybrid Warmback analysis, it is necessary to have a good injection schedule. In an embodiment herein, we describe how to calculate a baseline injection schedule and to plan a schedule for subsequent injection cycles for accurate injection profiling. The steps are as follows:

Step 1: Determine the Reference Temperature: For injector wells in greenfields, the Reference Temperature profile may be set as the Geothermal Temperature Profile. For brownfields, the Reference Temperature Profile should be set as the Long-Term Shut-In Temperature Profile, which may be calculated by any of the methods mentioned in the body.

Step 2: Baseline schedule generation: After an initial long-term shut-in (e.g., when the well first comes online), start the injection at a fixed flow rate $q_{base}$ for a predetermined short period of time, $t_{1_base}$. This period may preferably be less than a week in duration. Following this injection, shut-in the well and record the time for the appearance of the warmback signatures as $t_{2_base}$ and the time for the disappearance of the warmback signatures as $t_{3_base}$. The determination, and associated criteria and alternate ranges, as to the "appearance of the warmback signatures" and the "disappearance of the warmback signatures" is the same as prior noted in this disclosure.

Step 3: Planning a future injection schedule for the proposed Hybrid Warmback Analysis: Once the baseline schedule has been recorded from Step 2, this information may be used to plan an injection schedule for a future injection cycle. This calculation provides an estimate of the shut-in durations $t_2$ and $t_3$ that are needed, for a given choice of the total volume Q injection injected in the time period $t_1$. The times for the appearance and disappearance of the warmback signatures are directly proportional to the cumulative injection volume Q in the preceding injection window. As such, in order for the warmback analysis to be accurate, $t_{2_plan}$ and $t_{3_plan}$ can be calculated as follows:

$$t_{2_plan} = t_{2_base}\left(\frac{Q}{t_{1_base} \times q_{base}}\right) \quad \text{(Eq. 7)}$$

$$t_{3_plan} = t_{3_base}\left(\frac{Q}{t_{1_base} \times q_{base}}\right) \quad \text{(Eq. 8)}$$

Following the shut-in and prior to re-injection, update the Long-Term Shut-In Temperature with the wellbore temperature profile obtained at the end of time duration $t_{3_plan}$ using the approaches described in the body.

What is claimed is:

1. A method of estimating the relative cumulative volume of fluids injected into multiple zones of an injection well located in a hydrocarbon reservoir, comprising:

a) determining an injection period for the injection well when the injection well is injecting at least one injection fluid under steady state conditions;

b) inputting a geometry of the injection well into a processor containing a Conventional Warmback Analysis software package;

c) inputting the depths of the multiple zones of the hydrocarbon reservoir and the overburden of the hydrocarbon reservoir into the processor;

d) recording an injection temperature profile for the injection well during the injection period;

e) shutting in the injection well for a first shut-in period;

f) monitoring the temperature profile of the injection well during the first shut-in period and identifying a time coincident with the appearance of warmback signatures at the multiple zones;

g) recording an initial shut-in temperature profile of the injection well at a time coincident with the appearance of warmback signatures at reservoir depths during the first shut-in period and ending the first shut-in period;

h) continuing to monitor the temperature profile of the injection well after step g) during a second shut-in period and identifying a time coincident with the disappearance of warmback signatures at the multiple zones;

i) recording a long-term shut-in temperature profile of the injection well at a time coincident with the disappearance of warmback signatures at the multiple zones during the second shut-in period and ending the second shut-in period;

j) inputting the initial shut-in temperature profile as a shut-in temperature profile into the processor;

k) inputting the long-term shut-in temperature profile as a reference temperature profile into the processor;

l) inputting the duration of the first shut-in period and the duration of the second shut-in period into the processor;

m) analyzing the information input into the processor from the prior steps utilizing the Conventional Warmback Analysis software package; and n) obtaining computational results from the Conventional Warmback Analysis software package; wherein the computational results comprise relative cumulative fluid injection profiles along the injection well for the injection period.

2. The method of claim 1, further comprising:

determining either the appearance of a warmback signature or the disappearance of a warmback signature by:

solving a pure heat conduction problem between the wellbore and the surrounding rock fixed at a long-term shut-in temperature profile without considering any injection effects, wherein at any overburden depth (indicated by superscript ob), wherein the shut-in temperature satisfies the equation:

$$T_{LTSIT}^{ob}-T_{shutin}^{ob}(t)=(T_{LTSIT}^{ob}-T_{inj}^{ob})e^{-\lambda t},$$

wherein $T_{LTSIT}^{ob}$, $T_{shutin}^{ob}$ and $T_{inj}^{ob}$ refer to the long-term shut-in temperature, shut-in temperature and the injection temperature at the selected overburden depth, respectively, t indicates the time elapsed since the shut-in of the injection well, and λ represents the rate of exponential warm-up to the long-term shut-in temperature, at the overburden depth;

empirically estimating the exponential coefficient λ by plotting the difference $T_{LTSIT}^{ob}-T_{shutin}^{ob}(t)$ on a semi-logarithmic scale against time t at various times during the shut-in, fitting a straight line through the resulting data points, and estimating the coefficient λ as the negative slope of the fitted straight line; and calculating the multiple extrapolated shut-in temperatures for at least one pay zone of the injection well (indicated by $T_{extrap\text{-}shutin}^{pz}(t)$) by the formula:

$$T_{extra\text{-}shutin}^{pz}(t)=T_{LTSIT}^{pz}-(T_{LTSIT}^{pz}-T_{inj}^{pz})e^{-\lambda t};$$

determining the difference between each of the calculated extrapolated shut-in temperatures and the temperatures of the monitored temperature profiles for the at least one pay zone;

determining the appearance of a warmback signature or disappearance of a warmback signature if the difference between at least a portion of the temperatures of the monitored temperature profile for the at least one pay zone and their associated calculated extrapolated shut-in temperatures for the at least one pay zone is greater than a threshold value for the appearance of a warmback signature, or is less than a threshold value for the disappearance of a warmback signature.

3. The method of claim 2, wherein the at least a portion of the temperatures of the monitored temperature profile for the at least one pay zone is selected from at least one of:

at least 50% of all of the temperatures of the monitored temperature profile for the at least one pay zone;

at least 75% of all of the temperatures of the monitored temperature profile for the at least one pay zone;

at least 90% of all of the temperatures of the monitored temperature profile for the at least one pay zone;

all of the temperatures of the monitored temperature profile for the at least one pay zone;

within 20% of the calculated average of the temperatures of the monitored temperature profile for the at least one pay zone;

the calculated average of the temperatures of the monitored temperature profile for the at least one pay zone;

within 20% of the calculated median of the temperatures of the monitored temperature profile for the at least one pay zone;

the calculated median of the temperatures of the monitored temperature profile for the at least one pay zone.

4. The method of claim 2, wherein the threshold value is selected from:

less than 1° F.;

less than 5° F.;

less than 10° F.;

less than 25° F.;

less than 1% based on temperatures in ° F.;

less than 2% based on temperatures in ° F.;

less than 5% based on temperatures in ° F.; and less than 10% based on temperatures in ° F.

5. The method of claim 2, wherein the steps are performed for more than one pay zone of the injection well.

6. The method of claim 2, wherein the steps are performed for all of the pay zones of the injection well.

7. The method of claim 1, further comprising:

identifying at least one cooldown zone from the multiple of zones, wherein the temperatures of the initial shut-in temperature profile of the cooldown zone are higher than the long-term shut-in temperature profile;

selecting a $T_{mirror}$ value that is a higher temperature value than the temperatures of the initial shut-in temperature profile of the cooldown zone;

performing a transformation step in a pre-processor unit to transform the injection temperature profile of the cooldown zone, the initial shut-in temperature profile of the cooldown zone, and the long-term shut-in temperature profile of the cooldown zone, wherein the transformation step includes calculating mirrored values for the injection temperature profile of the cooldown zone, initial shut-in temperature profile of the cooldown zone, and the long-term shut-in temperature profile of the cooldown zone, to produce a mirrored injection temperature profile of the cooldown zone, mirrored initial shut-in temperature profile of the cooldown zone, and a mirrored long-term shut-in temperature profile of the cooldown zone; and substituting the mirrored injection temperature profile of the cooldown zone for the injection temperature profile of the cooldown zone, the mirrored initial shut-in temperature profile of the cooldown zone for the initial shut-in temperature profile of the cooldown zone, and the mirrored long-term shut-in temperature profile for the long-term shut-in temperature profile of the cooldown zone prior to inputting the injection temperature profile as the steady injection temperature profile into the processor, the initial shut-in temperature profile as a shut-in temperature profile into the processor; and inputting the long-term shut-in temperature profile as a reference temperature profile into the processor.

8. The method of claim 7, wherein the following equations are used in the transformation step:

$$T_{inj\text{-}mirrored}(y)=2T_{mirror}-T_{inj}(y)$$

$$T_{shutin\text{-}mirrored}(y)=2T_{mirror}-T_{shutin}(y)$$

$$T_{ref\text{-}mirrored}(y)=2T_{mirror}-T_{ref}(y)$$

9. The method of claim 1, wherein the injection well is a vertical well or a deviated well.

10. The method of claim 1, wherein the hydrocarbon reservoir comprises more than one pay zone.

11. The method of claim 1, wherein the hydrocarbon reservoir comprises at least two pay zones, wherein the two pay zones are separated by a substantially impermeable layer.

12. The method of claim 1, wherein the hydrocarbon reservoir is a mature reservoir.

13. The method of claim 1, wherein the hydrocarbon reservoir is a sub-cooled reservoir.

14. The method of claim 1, further comprising extracting hydrocarbons from the hydrocarbon reservoir based on the computational results.

15. A method of estimating the relative cumulative volume of fluids injected into multiple zones of an injection well located in a hydrocarbon reservoir, comprising:

a) determining an injection period for the injection well when the injection well is injecting at least one injection fluid under steady state conditions;

b) inputting a geometry of the injection well into a processor containing a Conventional Warmback Analysis software package;

c) inputting the depths of the multiple zones of the hydrocarbon reservoir and the overburden of the hydrocarbon reservoir into the processor;

d) recording an injection temperature profile for the injection well during the injection period;

e) shutting in the injection well for a first shut-in period;

f) monitoring the temperature profile of the injection well during the first shut-in period and identifying a time coincident with the appearance of warmback signatures at the multiple zones;

g) recording an initial shut-in temperature profile of the injection well at a time coincident with the appearance of warmback signatures at reservoir depths during the first shut-in period and ending the first shut-in period;

h) continuing to monitor the temperature profile of the injection well after step g) during a second shut-in period and identifying a time coincident with the disappearance of warmback signatures at the multiple zones;

i) calculating multiple long-term shut-in temperatures at multiple depths of the injection well, y, by utilizing a statistical toolbox to asymptotically extrapolate the temperatures of the monitored shut-in temperature profile in step h) by fitting a model that describes the exponential behavior of the wellbore temperature at each of the multiple depths by using the equation:

$$T_{LTSIT}-T_{shutin}(t)=(T_{LTSIT}-T_{inj})e^{-\lambda t},$$

wherein $T_{LTSIT}$, $T_{shutin}$ and $T_{inj}$ refer to the long-term shut-in temperature, the shut-in temperature and the injection temperature at the selected depth, respectively, t indicates the time elapsed since the well was shut-in, and λ represents the rate of exponential warm-up of the wellbore to the long-term shut-in temperature;

j) combining the multiple asymptotically extrapolated temperatures at each of the multiple depths to form a long-term shut-in temperature profile;

k) inputting the initial shut-in temperature profile as a shut-in temperature profile into the processor;

l) inputting the long-term shut-in temperature profile as a reference temperature profile into the processor;

m) inputting the duration of the first shut-in period and the duration of the second shut-in period into the processor;

n) analyzing the information input into the processor from the prior steps utilizing the Conventional Warmback Analysis software package; and o) obtaining computational results from the Conventional Warmback Analysis software package; wherein the computational results comprise relative cumulative fluid injection profiles along the injection well for the injection period.

16. The method of claim 1, further comprising performing at least one or more of the following actions based on the computational results:

initiate, cease, increase, or decrease a flow rate of the injection fluid from the injection well or from another injection well located in the reservoir;

initiate, cease, increase, or decrease the flow or flow rate of a production fluid from a production well located in the reservoir, to establish an injection pattern;

modify the injection pattern of the injection fluid along the well;

install or reactivate an additional well in the reservoir;

change injection pressure at the well head;

shut in flow to certain zones and/or open certain zones;

change the schedule of the injection cycle;

take the injection well or another existing well in the reservoir out of service;

apply a maintenance procedure to the well; or adjust the composition, temperature or pressure of the injection fluid.

17. A method for determining, for planning purposes, the duration of a subsequent injection schedule for an injection well located in a hydrocarbon reservoir, comprising:

during a first cycle, performing the steps comprising:

1a) shutting in the injection well;

1b) establishing a long-term shut-in temperature of the injection well;

1c) starting injection of an injection fluid into the injection well at a known rate for a short period of time, $q_{base}$;

1d) measuring and recording the period of injecting the injection fluid in step 1c) as $t_{1_base}$;

1e) stopping the injection of the injection fluid and shut in the injection well;

1f) measuring and recording the time for the appearance of the warmback signatures as $t_{2_base}$;

1g) measuring and recording the time for the disappearance of the warmback signatures as $t_{3_base}$; and determining the durations of the subsequent injection schedule by performing the steps comprising:

2a) beginning re-injection of the injection fluid into the injection well in normal operations for a period of time, $t_4$;

2b) measuring and recording the total cumulative amount of the injection fluid that has been injected during the period $t_4$ as Q; and 2c) determining, for planning purposes, the duration in the subsequent injection schedule for the warmback traces to appear as $t_{2_base}$ and the durations in the subsequent injection schedule for the warmback traces to disappear as $t_{3_base}$ from the following equations:

$$t_{2_plan} = t_{2_base}\left(\frac{Q}{t_{1_base} \times q_{base}}\right); \text{ and}$$

$$t_{3_plan} = t_{3_base}\left(\frac{Q}{t_{1_base} \times q_{base}}\right).$$

18. The method of claim 17, further comprising:

recording the temperature profile of the injection well at the end of step 1g); and updating the long-term shut-in temperature profile in a warmback analysis with the temperature profile of the injection well at the end of step 1g).

19. The method of claim 17, wherein the period of injecting the injection fluid in step 1c), $t_{1\ base}$, is less than 1 week.

* * * * *